US012741727B2

(12) United States Patent
Naganuma et al.

(10) Patent No.: US 12,741,727 B2
(45) Date of Patent: Sep. 22, 2026

(54) OUTBOARD MOTOR

(71) Applicant: SUZUKI MOTOR CORPORATION, Hamamatsu (JP)

(72) Inventors: Koji Naganuma, Hamamatsu (JP); Yuki Eidome, Hamamatsu (JP); Sho Okamoto, Hamamatsu (JP); Kazuya Nishiguchi, Hamamatsu (JP); Hiroki Kamikawa, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 182 days.

(21) Appl. No.: 18/917,041

(22) Filed: Oct. 16, 2024

(65) Prior Publication Data

US 2025/0128801 A1 Apr. 24, 2025

(30) Foreign Application Priority Data

Oct. 18, 2023 (JP) ..... 2023-179362

(51) Int. Cl.
*B63H 5/10* (2006.01)
*B63H 23/30* (2006.01)
*B63H 23/06* (2006.01)

(52) U.S. Cl.
CPC ..... *B63H 5/10* (2013.01); *B63H 23/30* (2013.01); *B63H 2023/062* (2013.01)

(58) Field of Classification Search
CPC ..... B63H 5/10; B63H 23/30; B63H 2023/06
See application file for complete search history.

(56) References Cited

U.S. PATENT DOCUMENTS

2016/0176492 A1* 6/2016 Achiwa ..... F16H 3/14 440/75

FOREIGN PATENT DOCUMENTS

JP 2015-202849 A 11/2015

* cited by examiner

*Primary Examiner* — Richard G Davis
(74) *Attorney, Agent, or Firm* — Stein IP, LLC

(57) ABSTRACT

An outboard motor includes upper and lower shafts extending from an engine toward a propeller, a transmission mechanism interposed between the upper and lower shafts, and a shift device that operates the transmission mechanism. The transmission mechanism includes an upper gear fixed to the upper shaft, a lower gear rotatably supported by the lower shaft, and an intermediate gear meshing with the upper and lower gears. The shift device includes a shift shaft extending downward from an actuator, a cam mechanism that converts rotation of the shift shaft into upper-lower movement of an operation portion, a shift slider coupled to the operation portion, a dog clutch coupled to the lower shaft and connectable to the upper or lower gear, and a connector pin coupling the shift slider and the dog clutch. The shift slider is positioned above the upper gear or below the lower gear.

6 Claims, 6 Drawing Sheets

OUTBOARD MOTOR

CROSS-REFERENCE TO RELATED APPLICATIONS

This application is based on and claims priority under 35 USC 119 from Japanese Patent Application No. 2023-179362 filed on Oct. 18, 2023, the contents of which are incorporated herein by reference.

BACKGROUND

The present disclosure relates to an outboard motor.

An outboard motor includes a shift device in which shift positions are switched by an actuator (for example, see JP2015-202849A). In the outboard motor described in JP2015-202849A, an upper shaft extends downward from an engine, and an upper bevel gear is fixed to a lower end portion of the upper shaft. The upper bevel gear is coupled to a lower bevel gear via a middle bevel gear, and a lower shaft is inserted into the lower bevel gear in a relatively rotatable manner. An upper end portion of the lower shaft protrudes from the lower bevel gear, and a dog clutch fixed to the upper end portion of the lower shaft is positioned in an opposing space between the upper bevel gear and the lower bevel gear.

In the shift device, the dog clutch is moved upward or downward between the upper bevel gear and the lower bevel gear by an actuator. When the dog clutch is moved upward and is coupled to the upper bevel gear, the shift position is switched to a forward position, and power of the engine is directly transmitted from the upper shaft to the lower shaft. When the dog clutch is moved downward and is coupled to the lower bevel gear, the shift position is switched to a reverse position, and the lower bevel gear and the lower shaft are coupled via the dog clutch. The power of the engine is reversely transmitted from the upper shaft to the lower shaft via the upper bevel gear, the middle bevel gear, and the lower bevel gear.

SUMMARY

According to an aspect of the present disclosure, there is provided an outboard motor including: an upper shaft and a lower shaft extending from an engine side to a propeller side; a power transmission mechanism interposed between the upper shaft and the lower shaft; and a shift device configured to operate the power transmission mechanism to reversely rotate a propeller. The power transmission mechanism includes: an upper gear fixed to a lower end portion of the upper shaft; a lower gear facing the upper gear from below; and an intermediate gear meshing with the upper gear and the lower gear. The lower gear is supported by the lower shaft in a relatively rotatable manner. The shift device includes: a shift shaft extending downward from an actuator side; a cam mechanism configured to convert rotation of the shift shaft into upper-lower movement of an operation portion; a shift slider coupled to the operation portion and slidable in an upper-lower direction; a dog clutch provided between the upper gear and the lower gear; and a connector pin coupling the shift slider and the dog clutch. The dog clutch is connectable to the upper gear or the lower gear. The dog clutch is coupled to the lower shaft in an integrally rotatable manner. The shift slider is positioned above the upper gear or below the lower gear.

DETAILED DESCRIPTION OF EXEMPLIFIED EMBODIMENTS

Figure 1:
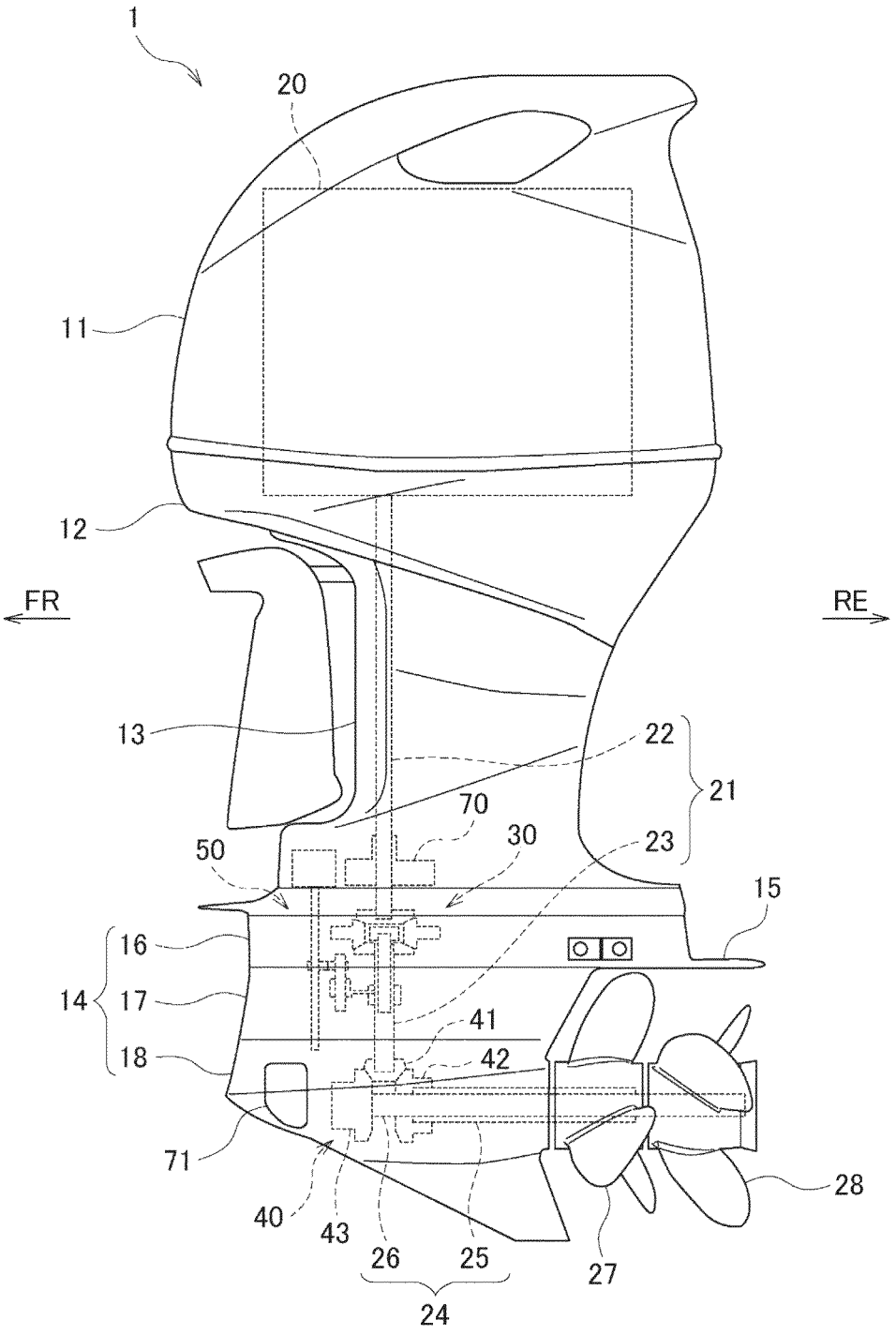
FIG. 1 is a side view of an outboard motor according to a present embodiment.

In the above configuration such as JP2015-202849A, since the dog clutch is positioned between the upper bevel gear and the lower bevel gear, components of the shift device are provided at substantially the same height as the upper bevel gear and the lower bevel gear. Therefore, the components of the shift device are positioned in front of the upper bevel gear and the lower bevel gear, and the shift device is increased in size. Further, the layout of the components of the shift device is limited to substantially the same height as the upper bevel gear and the lower bevel gear, and the degree of freedom in the component layout is reduced.

The present disclosure has been made in view of the above circumstances, and an object of the present disclosure is to provide an outboard motor capable of achieving reduction in size of a shift device and improving the degree of freedom in component layout of the shift device.

In an outboard motor according to one aspect of the present disclosure, an upper shaft and a lower shaft extend from an engine side to a propeller side, and a power transmission mechanism is interposed between the upper shaft and the lower shaft. When the power transmission mechanism is operated by a shift device, a propeller is reversely rotated. In the power transmission mechanism, a lower gear faces an upper gear from below, and an intermediate gear meshes with the upper gear and the lower gear. The upper gear is fixed to a lower end portion of the upper shaft, and the lower gear is supported by the lower shaft in a relatively rotatable manner. In the shift device, a shift shaft extends downward from an actuator side, and rotation of the shift shaft is converted into upper-lower movement of an operation portion by a cam mechanism. A shift slider slidable in an upper-lower direction is coupled to the operation portion, and a dog clutch is coupled to the shift slider via a connector pin. The dog clutch is supported by the lower shaft in an integrally rotatable manner. The dog clutch is provided between the upper gear and the lower gear, and the dog clutch is connected to the upper gear or the lower gear by upper-lower movement of the dog clutch. When the shift shaft is rotated by an actuator, the shift slider is moved in the upper-lower direction by the cam mechanism. Since the dog clutch is coupled to the shift slider via the connector pin, the dog clutch is moved in the upper-lower direction between the upper gear and the lower gear. When the dog clutch is connected to the upper gear, the upper shaft is coupled to the lower shaft in an integrally rotatable manner, and power of the engine is directly transmitted from the upper shaft to the lower shaft. When the dog clutch is connected to the lower gear, the lower gear is coupled to the lower shaft in an integrally rotatable manner via the dog clutch. The power of the engine is reversely transmitted to the lower shaft via the upper gear, the intermediate gear, and the lower gear. A rotation direction of the propeller is switched by reversing a rotation direction of the lower shaft. Further, the shift slider of the shift device is positioned above the upper gear or below the lower gear. Since the shift slider is offset in a height direction with respect to the upper gear and the lower gear, the shift device can be reduced in size by moving the shift shaft and the dog clutch closer together in a horizontal direction, and the degree of freedom in component layout of the shift device can be improved.

Embodiments

Figure 2:
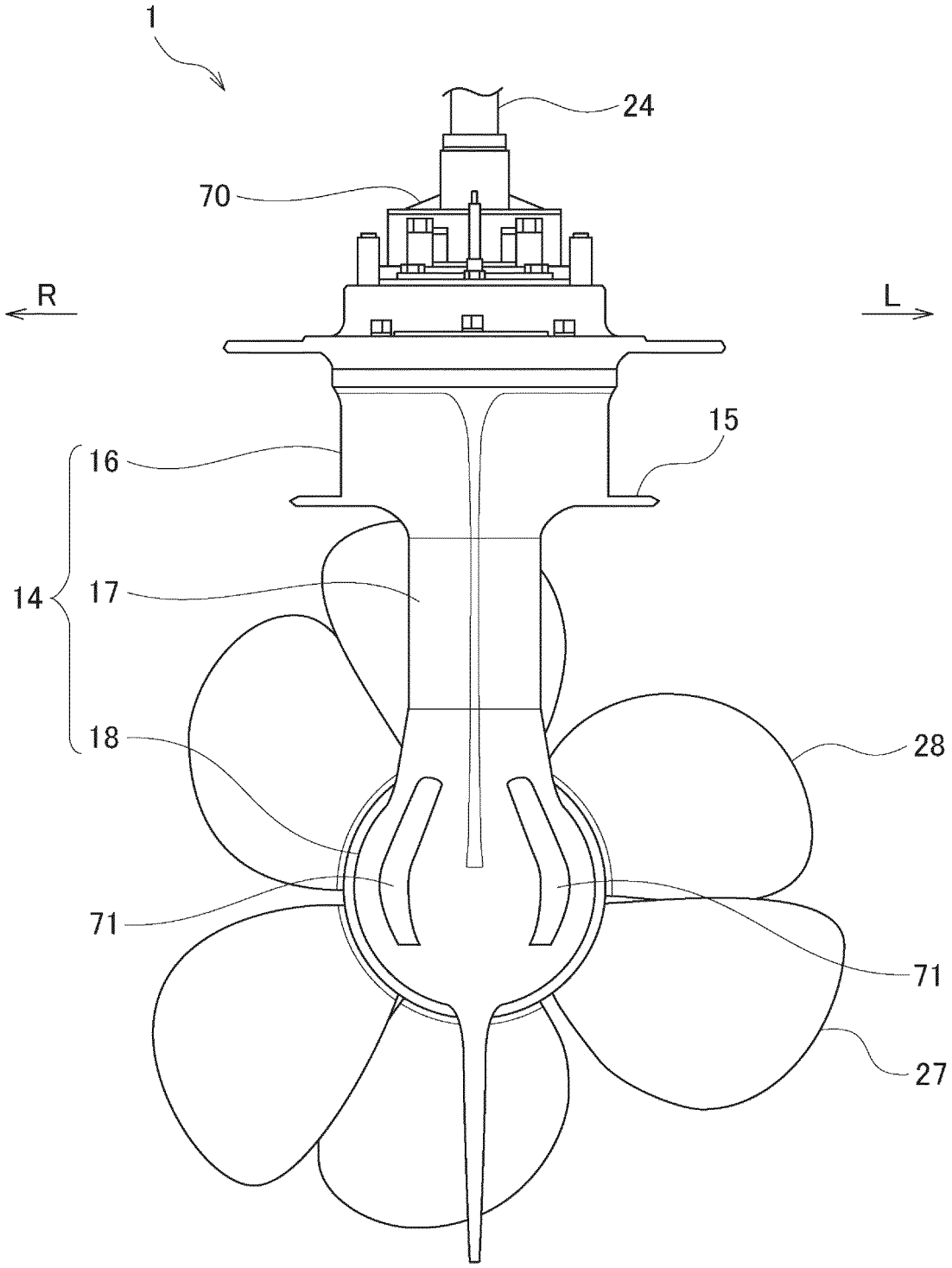
FIG. 2 is a front view of the outboard motor according to the present embodiment.

Hereinafter, an outboard motor according to a present embodiment will be described with reference to the accompanying drawings. FIG. 1 is a side view of the outboard motor according to the present embodiment. FIG. 2 is a front view of the outboard motor according to the present embodiment. In the following drawings, an arrow FR indicates a vehicle front side, an arrow RE indicates a vehicle rear side, an arrow L indicates a vehicle left side, and an arrow R indicates a vehicle right side.

As shown in FIGS. 1 and 2, an outboard motor 1 transmits a driving force of an engine 20 to contra-rotating propellers 27 and 28 to generate a propulsive force to a ship. The engine 20 and the like are accommodated inside a top cowl 11 and a bottom cowl 12 at an upper portion of the outboard motor 1. An upper housing 13 is provided at a lower portion of the bottom cowl 12, and a lower housing 14 is provided at a lower portion of the upper housing 13. A drive shaft 21 is accommodated in the upper housing 13 and the lower housing 14 in the upper-lower direction, and a propeller shaft 24 coupled to the drive shaft 21 is accommodated in the lower housing 14 in the horizontal direction.

The drive shaft 21 includes an upper drive shaft (the upper shaft) 22 and a lower drive shaft (the lower shaft) 23 extending from the engine 20 side to the propellers 27, 28 side (lower side). The upper drive shaft 22 and the lower drive shaft 23 are separated in the upper-lower direction, and a first gear mechanism (the power transmission mechanism) 30 is interposed between the upper drive shaft 22 and the lower drive shaft 23. As will be described in more detail below, the first gear mechanism 30 is coupled to a shift device 50, the first gear mechanism 30 is operated by the shift device 50 such that power of the engine 20 is transmitted or interrupted, and the propellers 27 and 28 are reversely rotated.

The propeller shaft 24 is orthogonal to the drive shaft 21, and a second gear mechanism 40 is interposed between the propeller shaft 24 and the drive shaft 21. The propeller shaft 24 is formed to have a double tube structure in which an inner propeller shaft 26 is inserted into a hollow outer propeller shaft 25. The inner propeller shaft 26 protrudes in a front-rear direction from a front end portion and a rear end portion of the outer propeller shaft 25. The front propeller 27 is fixed to the rear end portion of the outer propeller shaft 25, and the rear propeller 28 is fixed to a rear end portion of the inner propeller shaft 26.

The second gear mechanism 40 includes a lower drive gear 41, a rear driven gear 42, and a front driven gear 43. The lower drive gear 41 is fixed to a lower end portion of the lower drive shaft 23, the rear driven gear 42 is fixed to the front end portion of the outer propeller shaft 25, and the front driven gear 43 is fixed to a front end portion of the inner propeller shaft 26. The lower drive gear 41, the rear driven gear 42, and the front driven gear 43 are bevel gears, and the rear driven gear 42 and the front driven gear 43 mesh with the lower drive gear 41. The outer propeller shaft 25 and the inner propeller shaft 26 contra-rotate by rotation of the lower drive shaft 23.

The front propeller 27 fixed to the outer propeller shaft 25 includes three propeller blades, and the rear propeller 28 fixed to the inner propeller shaft 26 also includes three propeller blades. When the outer propeller shaft 25 and the inner propeller shaft 26 contra-rotate, the front propeller 27 and the rear propeller 28 contra-rotate. A swirling flow generated by the rotation of the front propeller 27 is recovered by the reverse rotation of the rear propeller 28, and thus the propulsion efficiency is improved, and counter torques generated by the rotation of the front propeller 27 and the rear propeller 28 are canceled.

Meanwhile, an anti-cavitation plate 15, which reduces air from being drawn into the propellers 27 and 28, is provided above the propellers 27 and 28 of the lower housing 14. The lower housing 14 has a widened portion 16 above the anti-cavitation plate 15, and the lower housing 14 has a narrowed portion 17 below the anti-cavitation plate 15. An accommodating portion 18 of the propeller shaft 24 is formed below the narrowed portion 17 to bulge in a shell shape. Since the lower housing 14 is positioned below water surface, if a front projection area of the lower housing 14 is small, traveling resistance is reduced and the acceleration is improved.

The first gear mechanism 30 is accommodated in the lower housing 14. As the shift device 50 is coupled to the first gear mechanism 30, if the shift device 50 is accommodated in the lower housing 14, the propeller shaft 24 may be lowered such that the front projection area of the lower housing 14 increases. Further, a water pump 70 for cooling the engine 20 is provided on an upper surface of the lower housing 14, and a distance from the water surface in the vicinity of the anti-cavitation plate 15 to the water pump 70 is increased in a planing state. Therefore, it is necessary to provide a large water pump for pumping up water from the water surface.

Accordingly, in the outboard motor 1 according to the present embodiment, reduction in size of pinion gears of the first gear mechanism 30, a gear transmission structure of the shift device 50, and layout of the shift device 50 using a lower space of the first gear mechanism 30 are adopted. The first gear mechanism 30 and the shift device 50 are reduced in size, and the shift device 50 is compactly provided inside the lower housing 14, thereby avoiding an increase in the front projection area of the lower housing 14. In addition, an increase in the distance from the water surface to the water pump 70 is avoided even in the planing state of the ship, and the small water pump 70 can be used for the outboard motor 1.

Figure 3:
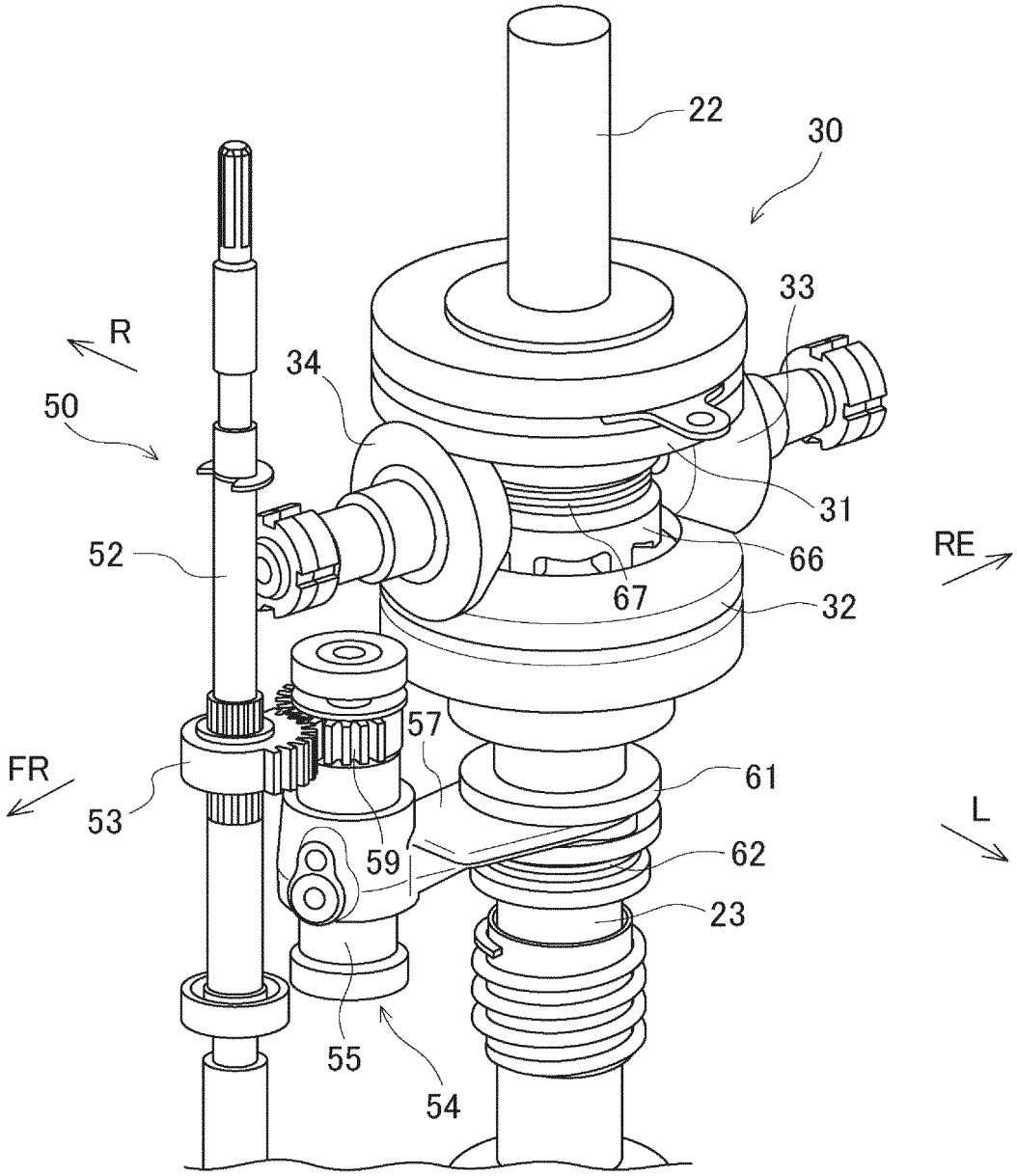
FIG. 3 is a perspective view of a first gear mechanism and a shift device according to the present embodiment.
Figure 4:
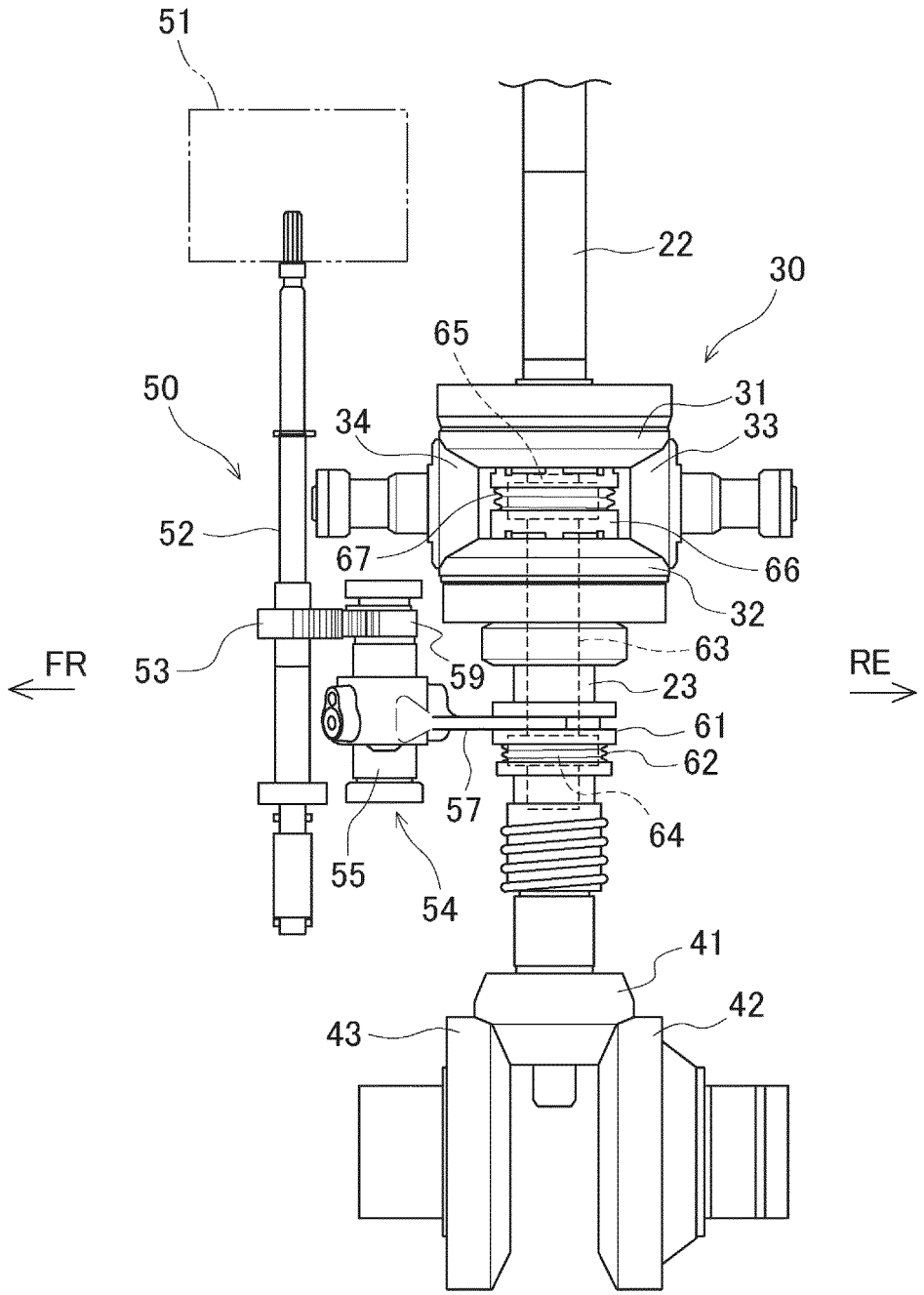
FIG. 4 is a side view of the first gear mechanism and the shift device according to the present embodiment.
Figure 5A:
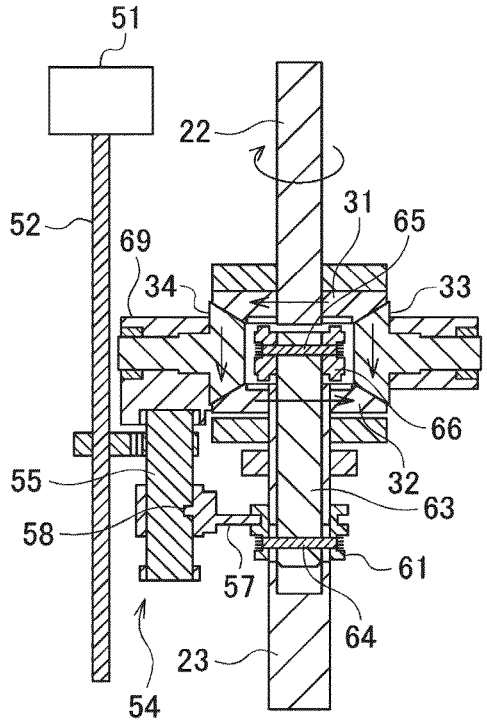
FIGS. 5A to 5C are illustration diagrams of a shift position switching operation according to the present embodiment.
Figure 5B:
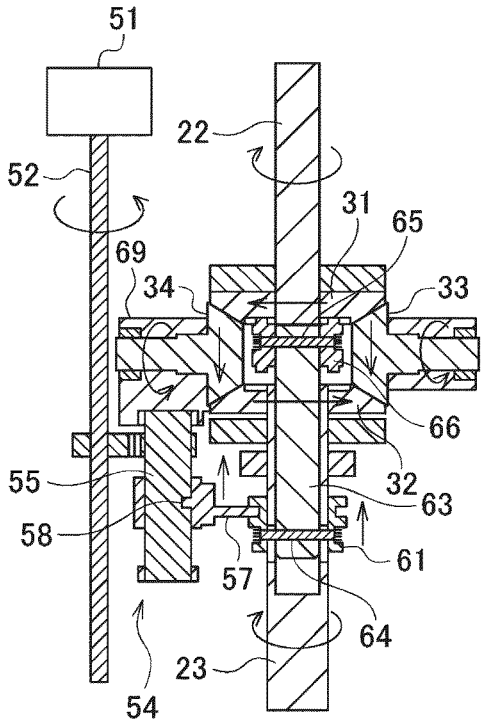
Figure 5C:
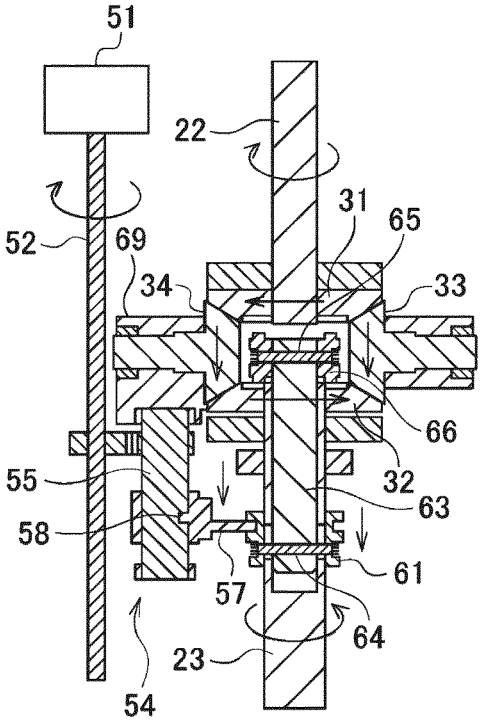

The first gear mechanism 30 and the shift device 50 will be described with reference to FIGS. 3 to 5C. FIG. 3 is a perspective view of the first gear mechanism 30 and the shift device 50 according to the present embodiment. FIG. 4 is a side view of the first gear mechanism 30 and the shift device 50 according to the present embodiment. FIGS. 5A to 5C are illustration diagrams of a shift position switching operation according to the present embodiment.

As shown in FIGS. 3 and 4, the first gear mechanism 30 includes an upper drive gear (the upper gear) 31, a lower driven gear (the lower gear) 32, and a pair of pinion gears (another intermediate gear and the intermediate gear) 33 and 34. The upper drive gear 31 is fixed to a lower end portion of the upper drive shaft 22, and the lower driven gear 32 is inserted into the lower drive shaft 23 and faces the upper drive gear 31 from below. The upper drive gear 31, the lower driven gear 32, and the pair of pinion gears 33 and 34 are bevel gears, and the pair of pinion gears 33 and 34 mesh with the upper drive gear 31 and the lower driven gear 32.

When rotation is transmitted from the upper drive gear 31 to the lower driven gear 32, the lower driven gear 32 reversely rotates with respect to the upper drive gear 31. The lower driven gear 32 is supported by the lower drive shaft 23 in a relatively rotatable manner, and the lower driven gear 32 and the lower drive shaft 23 are configured to be couplable to each other by a dog clutch 66 of the shift device 50. Power transmission from the lower driven gear 32 to the lower drive shaft 23 is interrupted when the lower driven gear 32 and the lower drive shaft 23 are not coupled, and the lower driven gear 32 and the lower drive shaft 23 are rotated integrally when the lower driven gear 32 and the lower drive shaft 23 are coupled to each other.

The shift device 50 actuates the dog clutch 66 via a shift shaft 52, a cam mechanism 54, a shift slider 61, and a connector pin 63 by using power of an actuator 51. The shift shaft 52 extends downward from the actuator 51 side, and a sector gear 53 having teeth formed in a predetermined region of an outer periphery is fixed to an intermediate portion of the shift shaft 52 in the height direction. The cam mechanism 54 is configured by attaching a shift fork (an operation portion) 57 to an outer peripheral surface of a cylindrical cam 55 in a slidable manner. A sector gear 59 having teeth formed in a predetermined region of an outer periphery is fixed to an upper end of the cylindrical cam 55, and the sector gear 59 meshes with the sector gear 53 of the shift shaft 52.

A cam groove is formed in a spiral shape on the outer peripheral surface of the cylindrical cam 55, and a follower 58 (see FIGS. 5A to 5C) inside a cylinder of the shift fork 57 enters the cam groove of the cylindrical cam 55. Rotation of the shift shaft 52 is transmitted to the cylindrical cam 55 via the sector gears 53 and 59, and the cylindrical cam 55 rotates to move the follower 58 of the shift fork 57 along the cam groove. Accordingly, the cam mechanism 54 converts the rotation of the shift shaft 52 into upper-lower movement of the shift fork 57. A tip of the shift fork 57 is bifurcated, and a fork portion of the shift fork 57 is coupled to the shift slider 61 provided on an outer peripheral surface of the lower drive shaft 23 in a movable manner.

The shift slider 61 is formed in a cylindrical shape, and the shift slider 61 is provided on the outer peripheral surface of the lower drive shaft 23 in a slidable manner. Two upper and lower annular grooves are formed on an outer peripheral surface of the shift slider 61. The fork portion of the shift fork 57 enters the upper annular groove of the shift slider 61, and the shift slider 61 slides in the upper-lower direction along the lower drive shaft 23 with the upper-lower movement of the shift fork 57. A disengagement prevention spring 62 is mounted in the lower annular groove of the shift slider 61, and a through pin 64 of the connector pin 63 to be described later is prevented from disengagement by the disengagement prevention spring 62.

The connector pin 63 is accommodated inside the lower drive shaft 23, and the connector pin 63 protrudes from an upper end of the lower drive shaft 23. The through pin 64 is inserted into a lower end portion of the connector pin 63 in the horizontal direction, and the through pin 64 protruding from an elongated hole, which extends in the upper-lower direction, of the lower drive shaft 23 is inserted into the shift slider 61. A through pin 65 is inserted into an upper end portion of the connector pin 63 in the horizontal direction, and the through pin 65 is inserted into the dog clutch 66 above the lower drive shaft 23. The shift slider 61 is coupled to the dog clutch 66 via the connector pin 63.

The dog clutch 66 is provided in an opposing space between the upper drive gear 31 and the lower driven gear 32. The dog clutch 66 is formed in a cylindrical shape, and an annular groove is formed in an outer peripheral surface of the dog clutch 66. A disengagement prevention spring 67 is mounted in the annular groove of the dog clutch 66, and the through pin 65 of the connector pin 63 is prevented from disengagement by the disengagement prevention spring 67. An upper surface of the dog clutch 66 faces a lower surface of the upper drive gear 31, and a lower surface of the dog clutch 66 faces an upper surface of the lower driven gear 32. A plurality of pawl portions are formed on opposing surfaces of the dog clutch 66 and the upper drive gear 31 and opposing surfaces of the dog clutch 66 and the lower driven gear 32.

Since the dog clutch 66 is coupled to the shift slider 61 via the connector pin 63, the dog clutch 66 moves the upper drive gear 31 and the lower driven gear 32 in the upper-lower direction in a releasable manner. The dog clutch 66 is connected to the upper drive gear 31 by being caught by the pawl portions of the dog clutch 66 and the upper drive gear 31, and the dog clutch 66 is connected to the lower driven gear 32 by being caught by the pawl portions of the dog clutch 66 and the lower driven gear 32. Further, the dog clutch 66 is fixed to the lower drive shaft 23 via the through pin 65, and the dog clutch 66 is coupled to the lower drive shaft 23 in an integrally rotatable manner.

As shown in FIG. 5A, when a shift position is a neutral position, the dog clutch 66 is positioned at a neutral location between the upper drive gear 31 and the lower driven gear 32. The dog clutch 66 is connected to neither the upper drive gear 31 nor the lower driven gear 32. The power of the engine 20 (see FIG. 1) is transmitted to the lower driven gear 32 via the upper drive gear 31 and the pair of pinion gears 33 and 34, but the lower driven gear 32 idles with respect to the lower drive shaft 23. Therefore, the power of the engine 20 is not transmitted from the upper drive shaft 22 to the lower drive shaft 23.

As shown in FIG. 5B, when the shift shaft 52 is rotated in one direction by the actuator 51, the rotation of the shift shaft 52 is converted into upward movement of the shift fork 57 by the cam mechanism 54. The shift slider 61 is slid upward along the lower drive shaft 23 by the shift fork 57. As the shift slider 61 slides, the dog clutch 66 moves upward from the neutral location, and the pawl portions of the dog clutch 66 are caught by the pawl portions of the upper drive gear 31. The dog clutch 66 is connected to the upper drive gear 31, and the shift position is switched from the neutral position to a forward position.

Since the upper drive shaft 22 is fixed to the upper drive gear 31 and the dog clutch 66 is coupled to the lower drive shaft 23 via the connector pin 63, the upper drive shaft 22 is coupled to the lower drive shaft 23. The power of the engine 20 is transmitted from the upper drive shaft 22 to the lower drive shaft 23, and the propellers 27 and 28 (see FIG. 1) are rotated to generate thrust in a forward direction. The power of the engine 20 is transmitted to the lower driven gear 32 via the upper drive gear 31 and the pair of pinion gears 33 and 34 even at the forward position, but the lower driven gear 32 idles with respect to the lower drive shaft 23.

As shown in FIG. 5C, when the shift shaft 52 is rotated in another direction by the actuator 51, the rotation of the shift shaft 52 is converted into downward movement of the shift fork 57 by the cam mechanism 54. The shift slider 61 is slid downward along the lower drive shaft 23 by the shift fork 57. As the shift slider 61 slides, the dog clutch 66 moves downward from the neutral location, and the pawl portions of the dog clutch 66 are caught by the pawl portions of the lower driven gear 32. The dog clutch 66 is connected to the lower driven gear 32, and the shift position is switched from the neutral position to a reverse position.

The lower driven gear 32 is coupled to the lower drive shaft 23 via the dog clutch 66. The power of the engine 20 is transmitted from the upper drive shaft 22 to the lower drive shaft 23 via the upper drive gear 31, the pair of pinion gears 33 and 34, and the lower driven gear 32, so that the propellers 27 and 28 (see FIG. 1) are reversely rotated to generate thrust in a reverse direction. Accordingly, when the dog clutch 66 moves in the upper-lower direction and the first gear mechanism 30 is operated, a transmission path from the upper drive shaft 22 to the lower drive shaft 23 is changed, and rotation directions of the propellers 27 and 28 are switched.

Figure 6:
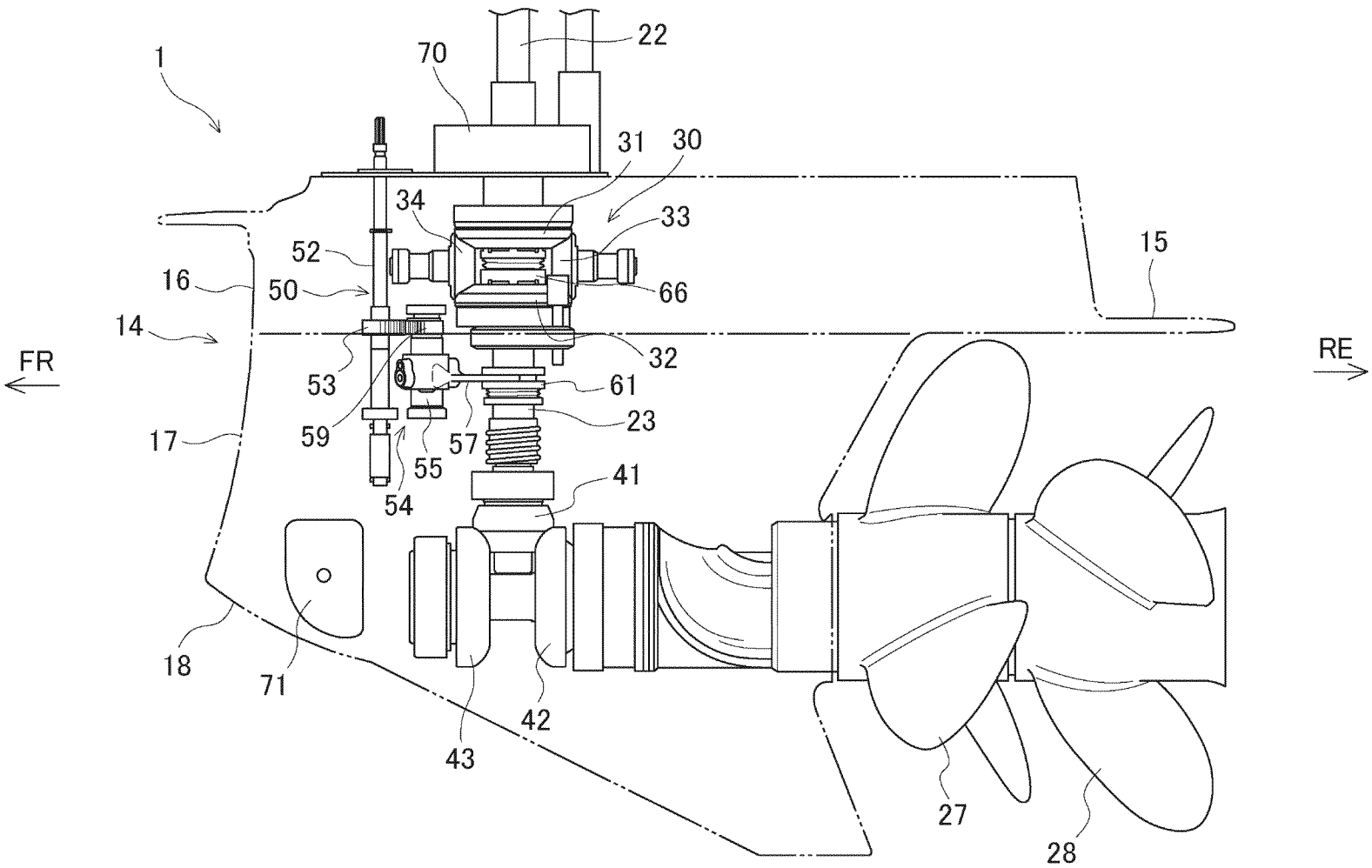
FIG. 6 is an illustration diagram of a component layout of the shift device and the first gear mechanism according to the present embodiment.

A component layout of the shift device 50 and the first gear mechanism 30 will be described with reference to FIG. 6. FIG. 6 is an illustration diagram of the component layout of the shift device 50 and the first gear mechanism 30 according to the present embodiment.

As shown in FIG. 6, the first gear mechanism 30 is positioned between the upper drive shaft 22 and the lower drive shaft 23, and the shift device 50 is positioned in front of the upper drive shaft 22 and the lower drive shaft 23. The first gear mechanism 30 is accommodated in the widened portion 16 of the lower housing 14, and the shift device 50 is accommodated across the widened portion 16 and the narrowed portion 17 of the lower housing 14. Specifically, the dog clutch 66 and upper half portions of the shift shaft 52, the cam mechanism 54 and the connector pin 63 (see FIGS. 5A to 5C) are accommodated in the widened portion 16, and the shift slider 61 and lower half portions of the shift shaft 52, the cam mechanism 54 and the connector pin 63 are accommodated in the narrowed portion 17.

By providing the shift slider 61 and the like of the shift device 50 in the narrowed portion 17, a height dimension of the widened portion 16 of the lower housing 14 is avoided. Since the height dimension of the widened portion 16 is reduced, the front projection area of the lower housing 14 is reduced, so that the traveling resistance is reduced. Further, the shift slider 61 is positioned below the lower driven gear 32. Unlike a configuration in which the dog clutch 66 is directly operated by the shift fork 57, it is not necessary to largely separate the shift fork 57 or the shift shaft 52 from the dog clutch 66. The shift device 50 is reduced in size by moving the shift shaft 52 and the dog clutch 66 closer together in the front-rear direction.

In the first gear mechanism 30, the pair of pinion gears 33 and 34 mesh with the upper drive gear 31 and the lower driven gear 32. The pair of pinion gears 33 and 34 face each other in the front-rear direction with the dog clutch 66 sandwiched therebetween. Since a torque of the upper drive shaft 22 is dispersed and transmitted to the pair of pinion gears 33 and 34, the strength of the pair of pinion gears 33 and 34 can be reduced to achieve the reduction in size of the gears. The reduction in size of the pinion gears 33 and 34 also reduces the height dimension of the widened portion 16 in which the first gear mechanism 30 is accommodated. As the outboard motor 1 is reduced in size and the front projection area of the lower housing 14 is reduced, the traveling resistance is reduced.

The pinion gear 34 is provided between the shift shaft 52 and the dog clutch 66. Even when the pinion gear 34 is provided on the shift shaft 52 side, the pinion gear 34 does not interfere with the shift device 50, and the pinion gear 34 and the shift device 50 are compactly provided in the widened portion 16 of the lower housing 14. The cam mechanism 54 is provided below the pinion gear 34. The shift device 50 is reduced in size by providing the cam mechanism 54 using a lower space of the pinion gear 34. In this case, the pinion gears 33 and 34 and the cylindrical cam 55 are supported by a single bearing housing 69 (see FIGS. 5A to 5C) in a rotatable manner.

As described above, the power is transmitted from the shift shaft 52 to the cam mechanism 54 by the gears. The amount of rotation of the shift shaft 52, a stroke of the dog clutch 66, and a shift load are adjusted by changing a gear ratio. The stroke of the dog clutch 66 is increased by the smaller amount of rotation of the shift shaft 52, so that the shift device 50 is reduced in size and is compactly provided in the lower housing 14. In the present embodiment, the number of teeth on the sector gear 59 of the cylindrical cam 55 is smaller than that of the sector gear 53 of the shift shaft 52. For example, the number of teeth on the sector gear 53 of the shift shaft 52 is set to "10", and the number of teeth on the sector gear 59 of the cylindrical cam 55 is set to "9".

The water pump 70 is provided on the upper drive shaft 22 on the upper surface of the lower housing 14. Water inlets 71 are formed in the accommodating portion 18 on a lower side of the lower housing 14, and water enters the lower housing 14 from the water inlets 71 to the height of the water surface. Since the height dimension of the widened portion 16 above the anti-cavitation plate 15 of the lower housing 14 is reduced, the distance from the water surface in the vicinity of the anti-cavitation plate 15 to the water pump 70 is reduced. Therefore, the water can be pumped up from the water surface and sent to the engine 20 even with the small water pump 70.

As described above, according to the outboard motor 1 of the present embodiment, when the dog clutch 66 is connected to the upper drive gear 31, the upper drive shaft 22 is coupled to the lower drive shaft 23 in an integrally rotatable manner, and the power of the engine 20 is directly transmitted from the upper drive shaft 22 to the lower drive shaft 23. When the dog clutch 66 is connected to the lower driven gear 32, the lower driven gear 32 is coupled to the lower drive shaft 23 in an integrally rotatable manner via the dog clutch 66. The power of the engine 20 is reversely transmitted to the lower drive shaft 23 via the upper drive gear 31, the pair of pinion gears 33 and 34, and the lower driven gear 32. As the rotation direction of the lower drive shaft 23 is reversed, the rotation directions of the propellers 27 and 28 are switched. In addition, since the shift slider 61 is positioned below the lower driven gear 32, the shift device 50 is reduced in size by moving the shift shaft 52 and the dog clutch 66 closer together in the horizontal direction, and the degree of freedom in the component layout of the shift device 50 is improved.

In the present embodiment, the shift slider is positioned below the lower driven gear, and the shift slider may be positioned above the lower driven gear. In this case, the cam mechanism is provided above the pair of pinion gears. Even in such a layout, the shift device is reduced in size by moving the shift shaft and the dog clutch closer together in the horizontal direction.

Further, in the present embodiment, the outboard motor includes the contra-rotating propellers, and the outboard motor may include a single propeller.

In addition, in the present embodiment, the power is transmitted from the upper drive gear to the lower driven gear via the pair of pinion gears, and the power may be transmitted from the upper drive gear to the lower driven gear via a single pinion gear.

Further, in the present embodiment, the power is transmitted from the shift shaft to the cam mechanism by the gears, and the power transmission mechanism from the shift shaft to the cam mechanism is not particularly limited.

As described above, according to a first aspect, there is provided an outboard motor (1) including: an upper shaft (the upper drive shaft 22) and a lower shaft (the lower drive shaft 23) extending from an engine (20) side to a propeller (27, 28) side; a power transmission mechanism (the first gear mechanism 30) interposed between the upper shaft and the lower shaft; and a shift device (50) configured to operate the power transmission mechanism to reversely rotate a propeller. The power transmission mechanism includes: an upper gear (the upper drive gear 31) fixed to a lower end portion of the upper shaft; a lower gear (the lower driven gear 32) facing the upper gear from below; and an intermediate gear (the pinion gear 34) meshing with the upper gear and the lower gear. The lower gear is supported by the lower shaft in a relatively rotatable manner. The shift device includes: a shift shaft (52) extending downward from an actuator side; a cam mechanism (54) configured to convert rotation of the shift shaft into upper-lower movement of an operation portion (the shift fork 57); a shift slider (61) coupled to the operation portion and slidable in an upper-lower direction; a dog clutch (66) provided between the upper gear and the lower gear; and a connector pin (63) coupling the shift slider and the dog clutch. The dog clutch is connectable to the upper gear or the lower gear. The dog clutch is coupled to the lower shaft in an integrally rotatable manner. The shift slider is positioned above the upper gear or below the lower gear. According to this configuration, when the shift shaft is rotated by the actuator, the shift slider is slid in the upper-lower direction by the cam mechanism. Since the dog clutch is coupled to the shift slider via the connector pin, the dog clutch is moved in the upper-lower direction between the upper gear and the lower gear. When the dog clutch is connected to the upper gear, the upper shaft is coupled to the lower shaft in an integrally rotatable manner, and the power of the engine is directly transmitted from the upper shaft to the lower shaft. When the dog clutch is connected to the lower gear, the lower gear is coupled to the lower shaft in an integrally rotatable manner via the dog clutch. The power of the engine is reversely transmitted to the lower shaft via the upper gear, the intermediate gear, and the lower gear. The rotation direction of the propeller is switched by reversing the rotation direction of the lower shaft. Further, since the shift slider is offset in the height direction with respect to the upper gear and the lower gear, the shift device can be reduced in size by moving the shift shaft and the dog clutch closer together in the horizontal direction, and the degree of freedom in component layout of the shift device can be improved.

According to a second aspect, in the first aspect, the shift slider is provided on an outer peripheral surface of the lower shaft in a movable manner, and the connector pin is accommodated inside the lower shaft. According to this configuration, the connector pin can be provided using an inner space of the lower shaft.

According to a third aspect, in the first aspect or the second aspect, the intermediate gear is provided between a rotation shaft of the shift shaft and the dog clutch. According to this configuration, even when the intermediate gear is provided on the shift shaft side, the intermediate gear does not interfere with the shift device, and the intermediate gear and the shift device can be compactly provided.

According to a fourth aspect, in the third aspect, the power transmission mechanism includes another intermediate gear (the pinion gear 33) meshing with the upper gear and the lower gear, and the another intermediate gear faces the intermediate gear with the dog clutch sandwiched therebetween. According to this configuration, since the torque of the upper shaft is dispersed, the strength of the intermediate gear and the another intermediate gear can be reduced to achieve the reduction in size thereof. The outboard motor can be reduced in size due to the reduction in size of the intermediate gear and the another intermediate gear.

According to a fifth aspect, in any one of the first aspect to the fourth aspect, the cam mechanism is provided above or below the intermediate gear. According to this configuration, the shift device can be reduced in size by providing the cam mechanism using an upper space or the lower space of the intermediate gear.

According to a sixth aspect, in any one of the first aspect to the fifth aspect, power is transmitted from the shift shaft to the cam mechanism by a gear. According to this configuration, the amount of rotation of the shift shaft, the stroke of the dog clutch, and the shift load are adjusted by changing the gear ratio. The stroke of the dog clutch can be increased by the smaller amount of rotation of the shift shaft, so that the shift device can be reduced in size.

Although the present embodiment has been described, a part or all of the embodiment and modifications described above may be combined as another embodiment.

The technique according to the present disclosure is not limited to the embodiment described above, and may be variously changed, replaced, or modified without departing from the gist of the technical concept. Further, the present disclosure may be implemented by other methods as long as the technical concept can be implemented by the methods through advance of the technique or other derivative techniques. Therefore, the claims cover all embodiments that may fall within the scope of the technical concept.

What is claimed is:

1. An outboard motor comprising:

an upper shaft and a lower shaft extending from an engine side to a propeller side;

a power transmission mechanism interposed between the upper shaft and the lower shaft; and a shift device configured to operate the power transmission mechanism to reversely rotate a propeller, wherein the power transmission mechanism includes:

an upper gear fixed to a lower end portion of the upper shaft;

a lower gear facing the upper gear from below; and an intermediate gear meshing with the upper gear and the lower gear, wherein the lower gear is supported by the lower shaft in a relatively rotatable manner, wherein the shift device includes:

a shift shaft extending downward from an actuator side;

a cam mechanism configured to convert rotation of the shift shaft into upper-lower movement of an operation portion;

a shift slider coupled to the operation portion and slidable in an upper-lower direction;

a dog clutch provided between the upper gear and the lower gear; and a connector pin coupling the shift slider and the dog clutch, wherein the dog clutch is connectable to the upper gear or the lower gear, wherein the dog clutch is coupled to the lower shaft in an integrally rotatable manner, and wherein the shift slider is positioned above the upper gear or below the lower gear.

2. The outboard motor according to claim 1, wherein the shift slider is provided on an outer peripheral surface of the lower shaft in a movable manner, and wherein the connector pin is accommodated inside the lower shaft.

3. The outboard motor according to claim 1, wherein the intermediate gear is provided between a rotation shaft of the shift shaft and the dog clutch.

4. The outboard motor according to claim 3, wherein the power transmission mechanism includes another intermediate gear meshing with the upper gear and the lower gear, and wherein the another intermediate gear faces the intermediate gear with the dog clutch sandwiched therebetween.

5. The outboard motor according to claim 3, wherein the cam mechanism is provided above or below the intermediate gear.

6. The outboard motor according to claim 1, wherein power is transmitted from the shift shaft to the cam mechanism by a gear.

* * * * *